United States Patent [19]

Suinat et al.

[11] Patent Number: 4,546,894

[45] Date of Patent: Oct. 15, 1985

[54] HOODED STOPPER

[75] Inventors: Jean-Pierre A. Suinat, Soisy; Rene P. J. Suinat, Enghien les Bains, both of France

[73] Assignee: Anciens Ateliers Macler P. Suinat & Cie Srs, Taverny, France

[21] Appl. No.: 643,824

[22] Filed: Aug. 24, 1984

[30] Foreign Application Priority Data

Sep. 8, 1983 [FR] France ..... 83 14312

[51] Int. Cl.[4] ..... B65D 41/28

[52] U.S. Cl. ..... 215/354; 215/364

[58] Field of Search ..... 215/354, 364

[56] References Cited

U.S. PATENT DOCUMENTS

| | | | |
|---|---|---|---|
| 456,480 | 7/1891 | Cziner | 215/354 X |
| 666,911 | 1/1901 | Steinberg | 215/364 X |
| 1,168,410 | 1/1916 | Nothstine | 215/354 X |
| 2,192,511 | 3/1940 | Thomas | 215/364 |

FOREIGN PATENT DOCUMENTS

| | | | |
|---|---|---|---|
| 819654 | 11/1951 | Fed. Rep. of Germany | 215/364 |
| 822570 | 1/1938 | France . | |
| 847021 | 10/1939 | France . | |
| 1133724 | 4/1957 | France . | |
| 1057605 | 10/1958 | France | 215/354 |
| 1217914 | 5/1960 | France . | |
| 1461929 | 12/1966 | France . | |

*Primary Examiner*—Donald F. Norton

*Attorney, Agent, or Firm*—Stevens, Davis, Miller & Mosher

[57] ABSTRACT

The invention relates to an enveloping or hooding stopper comprising a male piece constituted by a plate bordered by a skirt and comprising a teat at its center, on the same side as the skirt with respect to the plate. It further comprises a female piece or insert made of a material more malleable than that of the male piece, disposed on this teat and wedged by appropriate means between the teat, the plate and the skirt. The invention is particularly applicable in the bottling industry.

4 Claims, 1 Drawing Figure

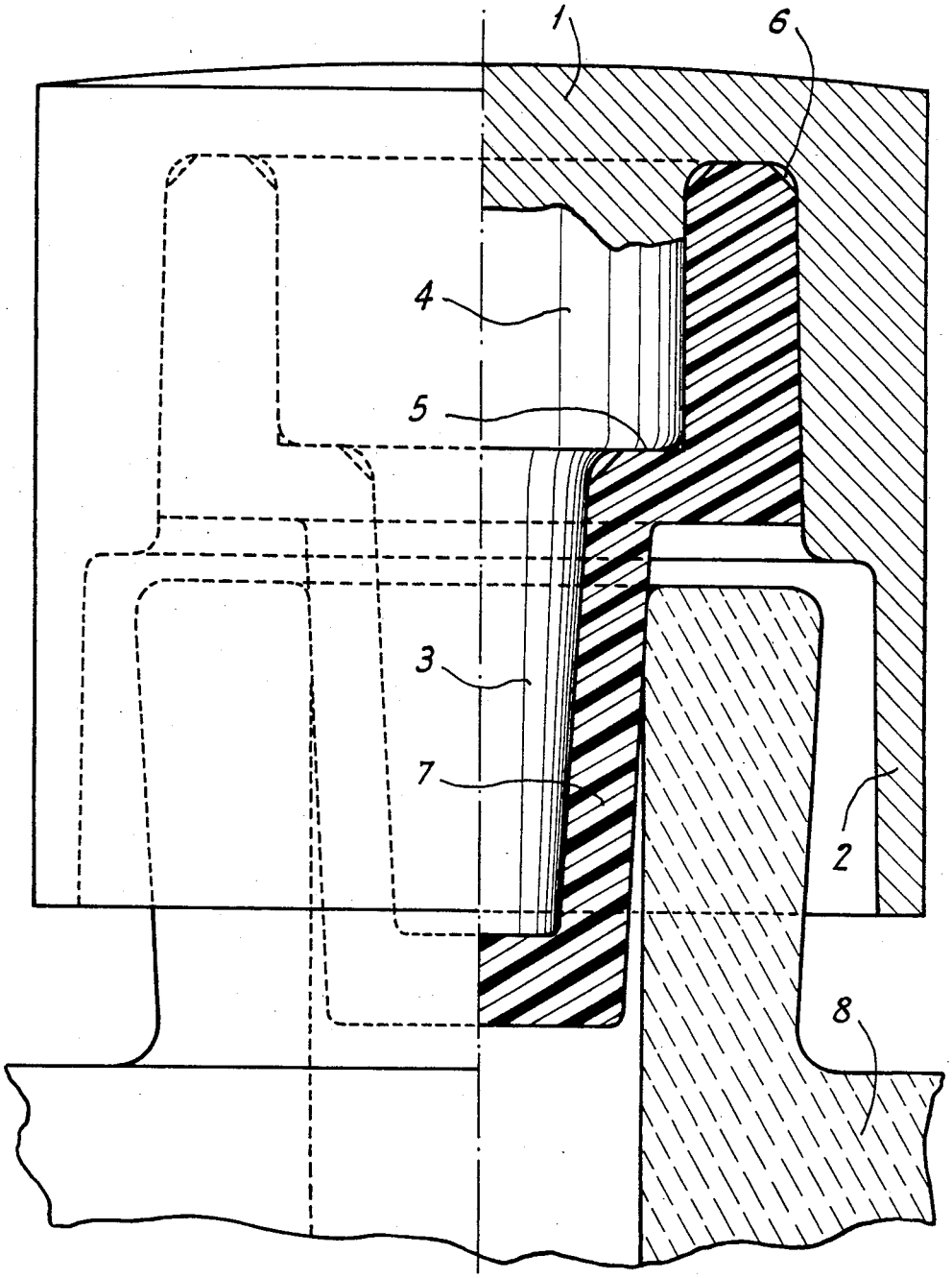
1
6
4
5
3
7
2
8

HOODED STOPPER

The present invention relates to an enveloping or hooding stopper which may be used in particular to close bottles of perfume.

Enveloping or hooding stoppers are stoppers constituted by a central part for blocking the opening of the neck of a bottle, and by a skirt which envelops, or hoods, this neck, completely or partially. The bottle is therefore stoppered solely by pressing the stopper on the neck, the skirt performing only an aesthetic role.

A known type of press-on stoppering is the one used in particular for bottles of chemical products: this is a ground glass stoppering system of which the major drawback is that of requiring a marrying of the stopper and of the bottle. One stopper corresponds to one bottle, and vice versa. Such a stoppering system is consequently very expensive and can only be considered for precious substances such as chemical or pharmaceutical products.

Another stoppering system of the same type is also known, in which the stopper is constituted by a plate on which is centrally mounted a teat, coated by overmoulding with a layer of plastics material. Manufacture of such a stopper necessitates providing catching means on the teat so that the layer remains fast therewith during traction and/or rotation. In the case of enveloping or hooding stoppers, such catch means can only be provided on the teat if said teat is a piece fitted by force. Moreover, such a stopper requires that the process of overmoulding be mastered.

It is therefore an object of the present invention to provide a stopper of which the process of manufacture overcomes the above drawbacks.

A further object of the invention is an enveloping or hooding stopper of low manufacturing cost.

These objects, and others which will appear hereinafter, are attained by an enveloping or hooding stopper comprising a male piece constituted by a plate bordered by a skirt and comprising a teat at its centre, on the same side as the skirt with respect to the plate, which stopper further comprises, according to the present invention, a female piece or insert made of a material more malleable than that of the male piece, disposed on this teat and wedged by appropriate means between the teat, the plate and the skirt.

According to a preferred embodiment of the invention, the teat is disposed on a base around which a groove is formed, a shoulder being made at the connection of the teat on this base.

The insert is maintained in position either by gluing, clipping, crimping or by a judicious choice of dimensions.

The male piece is advantageously made of metal and the insert of plastics material.

The invention will be more readily understood on reading the following description with reference to the accompanying drawings, in which:

The single FIGURE shows, in part section, an enveloping or hooding stopper according to the present invention, disposed on a bottle.

Referring now to the drawing, this FIGURE shows an enveloping or hooding stopper according to the present invention, which comprises a male part constituted by a plate 1, bordered by a skirt 2 and comprising a teat 3 at its centre, on the same side as this skirt with respect to the plate.

Teat 3 according to this embodiment is disposed on a base 4 which may be circular or polygonal, a shoulder 5 being made at the connection of the teat 3 on this base 4. The teat may either be of uniform diameter over the whole of its height, or may be slightly conical from the base 4 towards its end.

Around the base 4 there is formed a groove 6: the latter is therefore defined by the base 4, the plate 1 and the inner wall of the skirt 2.

According to the invention, this enveloping or hooding stopper also comprises a female part or insert 7 disposed on the teat 3 and wedged by appropriate means, for instance forced thereinto, between the teat 3, the plate 1 and the skirt 2. This insert 7 is advantageously made of a material more malleable than that of the male part.

This insert 7 may be maintained on the male piece, in fact on the teat 3, in several ways. For example, the insert 7 is fitted on the teat 3 so as not only to cover it, but also to cover the base 4 and fill the groove 6: only the choice of the respective dimensions allows the two pieces to remain fast with each other both in traction and in rotation. This aim can also be attained by a judicious choise of shapes.

To avoid rotation of the insert 7, its internal surface may comprise vertical ribs.

The female part or insert 7 may also be maintained on the teat 3 of the male part by gluing, clipping, crimping or by any combination of these means including the one described hereinabove.

The male part is generally made of metal and the female part of a plastics material. However, the male part may also be made of a plastics material, which implies that the plastics material of the female part is more malleable so as to allow it to fit on the teat 3. In other words, the male part is made of a substantially rigid material compared with the one of the female part.

When such a stopper is placed on the neck 8 of a bottle, seal is obtained by compression of the insert 7 between this neck 8 and the teat 3, by vertical pressure. The skirt 2 then covers this neck more or less as a function of the desired aesthetic effect.

The man skilled in the art will readily appreciate that such an enveloping or hooding stopper may be used on bottles of the same series: it is not adapted to one particular bottle.

We claim:

1. A hooded stopper comprising a male piece constituted by a plate, a skirt bordering said plate, a base on said plate defining a groove between said base and said skirt and a teat disposed on an end of said base and a female piece made of a material more malleable than that of the male piece, disposed on said teat in contact with and wedged between the base, the plate and the skirt.

2. The stopper of claim 1, wherein the connection of the teat on the base defines a shoulder.

3. The stopper of claim 1, wherein said male piece and said female piece are glued together.

4. The stopper of claim 1, wherein said male piece is made of metal and said female piece is made of plastics material.

* * * * *